US005651652A

United States Patent [19]

Williams et al.

[11] Patent Number: 5,651,652

[45] Date of Patent: Jul. 29, 1997

[54] BREAKAWAY TAMPERPROOF FASTENER

[76] Inventors: David J. Williams, N. 18302 Hardesty Rd., Colbert, Wash. 99005; Mark K. Williams, W. 5411 Princeton Pl., Spokane, Wash. 99205

[21] Appl. No.: 715,786

[22] Filed: Sep. 19, 1996

[51] Int. Cl.[6] ..... F16B 19/00

[52] U.S. Cl. ..... 411/508; 411/509; 411/908; 411/913

[58] Field of Search ..... 411/34, 37, 38, 411/43, 508, 509, 510, 908, 910, 913

[56] References Cited

U.S. PATENT DOCUMENTS

| | | | |
|---|---|---|---|
| 930,113 | 8/1909 | Adams . | |
| 1,690,853 | 11/1928 | Behrman . | |
| 2,657,948 | 11/1953 | Sturtevant | 296/1 |
| 3,271,059 | 9/1966 | Pearson | 411/509 |
| 3,720,037 | 3/1973 | Jaeger | 24/73 PF |
| 3,727,271 | 4/1973 | Znamirowski | 24/73 P |
| 3,776,092 | 12/1973 | Seckerson . | |
| 3,905,270 | 9/1975 | Hehl | 411/509 |
| 4,363,160 | 12/1982 | Wibrow | 24/297 |
| 4,517,710 | 5/1985 | Beckmann | 411/508 X |
| 4,682,688 | 7/1987 | Budert | 206/1.5 |
| 4,715,095 | 12/1987 | Takahashi | 411/508 X |
| 5,012,941 | 5/1991 | Abrams et al. | 215/250 |
| 5,173,026 | 12/1992 | Cordola et al. | 411/508 |
| 5,551,816 | 9/1996 | Brewer et al. | 411/43 |

*Primary Examiner*—Neill R. Wilson
*Attorney, Agent, or Firm*—Keith S. Bergman

[57] ABSTRACT

An elongate fastener that may not be removed without destruction is provided for insertion in adjacent cooperating holes defined in box structures and their closure elements to maintain closure. The fastener defines a head, larger than the hole to carry the fastener, that structurally carries a peripherally extending tab to aid manual manipulation. The head structurally connects an elongate perpendicularly extending body that fits in the cooperating holes and is formed by spaced peripheral webs that carry barb-like fasteners in their end portions distal from the head that allow insertion of the body through a hole by deformation, but thereafter expand responsive to retentent memory to prevent removal. The interconnection of the body and head is weaker in tensile strength than the material on either side of the interconnection so that the head may be removed from the body by manual manipulation of the peripheral tab, without the use of tools, to allow opening of the box structure.

5 Claims, 1 Drawing Sheet

BREAKAWAY TAMPERPROOF FASTENER

BACKGROUND OF INVENTION

RELATED APPLICATIONS

There are no applications related hereto heretofore filed in this or any foreign country.

FIELD OF INVENTION

This invention relates to an elongate headed fastener that is manually placed to extend through adjacent holes in a box structure and may be removed by manual manipulation without the use of tools, but not without destruction of the fastener.

BACKGROUND AND DESCRIPTION OF PRIOR ART

In modern commerce, it is common in transferring smaller merchandise in less than case lots from a wholesaler, jobber or distributor to a retailer to assemble and enclose a quantity of miscellaneous goods in a closable box-like container for transport and delivery. This practice has become particularly popular in the distribution and delivery of drugs or other pharmaceutical products and merchandise. Pilferage of a container's contents, however, is an ever present problem, and it is especially pronounced in the distribution of drugs and pharmaceutical products because of their relatively high value and normally small package size. The problem has long been recognized and various solutions proposed, but none of those solutions have resolved all of the problems involved or have presented any anti-pilfering apparatus or process that has received wide or general acceptance in the pharmaceutical industry, or even in the merchandising industry in general. The instant invention provides a novel, tamperproof fastener that requires destruction for removal to resolve problems that have not been solved by other prior fasteners or fastening methods.

The present day containers, commonly called "tote boxes", in which merchandise, and especially drugs and pharmaceutical products, are transported to retail merchandisers generally are truncated pyramidal structures having their base uppermost, a generally rectilinear cross-section, a somewhat enlarged upper rim and a closable top that allow convenient stacking when not in use. The closable top may provide a single planar element hingeably connected to one side of the upper orifice of the box, or more commonly comprises two medially overlapping top elements, each hingeably interconnected to opposite sides of the box orifice. Such boxes generally provide vertically adjacent cooperating fastening holes defined in overlapping portions of the top closure elements or in a closure element and the adjacent upper rim of the box.

Various fastening devices have heretofore become known for insertion in such pairs of cooperating holes in tote boxes to maintain box closure, and in the more recent history of such devices, many of such fasteners have been of such nature that once inserted they may not be removed without destruction, to indicate tampering between the time of fastening and the time of opening of the tote box. Such fasteners as have become known, however, have generally required the use of a tool of some sort to disconnect fastener parts to allow opening of a box. This type of fastener has not gained any wide acceptance in the merchandising business for various reasons. With a tool required to sever the fastener, a person desiring to open a tote box may not have the appropriate tool conveniently accessible to perform the function. The use of secondary tools, and especially knife-type structures, may potentially cause injury to a person opening a tote box and improper use of the tool or accident may also cause damage to the tote box itself. Prior fasteners also have often been created with specific configurations that allow their use in only a particular type or style of tote box or hole, and that configuration is often so specialized that the fasteners may not be generally used with the different types of tote boxes in common use in present day commerce. Prior fasteners also have often been difficult to initially place and in some instances have required the use of a specialized tool for their placement.

Our fastener in distinction from prior fasteners has been specifically created to resolve these problems. It provides a distinct head structure and body structure interconnected with each other so that the portion of the fastener least resistive to tensile stress is the area of interconnection between the body and the head of the fastener. The fastener head is provided with a peripheral outwardly extending tab which may be manually manipulated by a user to cause severance of the top from the body without the use of any external tools. This structure also allows adjustable determination of the force required to sever the fastener head from the body by reason of the configuration and design of the head and body structures at or adjacent to their interconnection, and particularly the cross-sectional size of material at the interconnection.

The elongate body of the instant fastener is an elongate peripherally defined structure formed by a plurality of webs each spacedly related, of relatively small cross-sectional area and defining barb-like connectors in their end portions distal from the top. With this structure, the web-like elements are deformable in the insertion process to allow the fastener to be manually inserted in a hole sized and configured to carry it. Additionally this structure allows substantial adjustability by reason of the design of the web elements which may be made larger or smaller to increase or decrease the force required for deformation upon insertion and also the force resisting removal by attempting to pull the fastener outwardly in an axial direction from a hole carrying it.

The structure of the fastener is such that it may be formed from polymeric or resinous materials by molding processes to provide the economic benefits derived from this manufacturing method. This material also allows a wide choice of physical parameters which in turn allow further adjustable determination of fastener characteristics.

Commonly it is desirable to fasten the closure elements of tote boxes immediately inwardly adjacent peripheral edges but in modern commerce, the designs of tote boxes often have provided rims or ridges about the periphery of closure elements that tend to interfere with the placement of fasteners having heads of any substantial size and of some particular shapes. Our fastener is not dependent upon a particular head shape or size by reason of its general structure, and the head therefore may be variously shaped in peripheral form from a circle through a segment or segment and in non-circular shapes from a square, to a rectangle or other polygonal shapes without interfering with its operation or any of the benefits provided by it to allow placement adjacent rims and other such protuberances.

Our invention resides not in any one of these features individually, but rather in the synergistic combination of all of its structures that combine to necessarily give rise to the functions flowing therefrom, as herein specified and claimed.

SUMMARY OF INVENTION

Our invention provides an elongate headed fastener that after insertion in adjacent cooperating holes cannot be removed without destruction. The fastener has a flat head of areal extent greater than a hole to carry it and with a tab extending spacedly from its periphery to aid manual manipulation. The head structurally carries in the medial portion of its inner surface plural fastener links that interconnect an elongate body formed by plural spaced peripheral webs interconnected in their outer end portions distal from the head. Each web provides a barb-type fastening element that may be deformed inwardly to allow insertion of the body in a hole, but thereafter returns to its original configuration by reason of resilient memory to prevent removal through the hole. The area at the interconnection of the fastener links with the webs has less resistance to withstand extensive forces than other adjacent portions of the fastener to allow severance of the head from the body by manual manipulation of the tab without the use of tools. The fastener is configured to allow formation by injection molding of settable polymeric or resinous materials.

In providing such a product, it is:

A principal object to provide a fastener for closure elements of box structures that fastenably extends through two adjacent aligned holes, at least one of which is defined in a closure element.

A further object is to provide such a fastener that has a head carrying a body with spacedly adjacent barb-type fastening structure that may be deformed inwardly to allow insertion through carrying holes but thereafter returns to its initial shape larger than the holes to prevent removal of the fastener from the holes without destruction.

A further object is to provide such a fastener that has an interconnection of the head and body portions that will withstand less tensile force in a generally axial direction than other adjacent portions of the fastener, so that the head may be severed from the body at the area of interconnection by manual manipulation.

A further object is to provide such a fastener that has a tab extending outwardly from the periphery of the head to aid manual manipulation in applying force to sever the head from the body without the use of any tools.

A further object is to provide such a fastener that has a body formed by a plurality of peripheral spaced web elements, each interconnected in its end distal from the head to allow and aid deformation of the body for insertion in an incrementally larger hole by manual manipulation.

A still further object is to provide such a fastener that is structurally configured so that it may be manufactured by injection molding of polymeric or resinous plastic materials.

A still further object is to provide such a fastener which may be used to fasten the closure elements of tote boxes, especially as used in the pharmaceutical industry, to maintain that closure under normal conditions and to indicate tampering with the fastener between the fastening of the closure elements and the opening of the tote box by destroying the fastener.

A still further object is to provide such a fastener that can be placed and removed by manual manipulation without the use of tools of any kind and that may be used in most tote boxes of present commerce without modification of or damage to those tote boxes.

A still further object is to provide such a fastener that is of new and novel design, of rugged and durable nature, of simple and economic manufacture and one otherwise well adapted to the uses and purposes for which it is intended.

Other and further objects of our invention will appear from the following specification and accompanying drawings which form a part hereof. In carrying out the objects of our invention, however, it is to be remembered that its accidental features are susceptible of change in design and structural arrangement, with only preferred and practical embodiments of the best known modes of our invention being illustrated and specified as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Our invention generally provides a fastener having head 11 interconnecting elongate body 12 to be inserted in cooperating holes defined in tote box 10.

Figure 1:
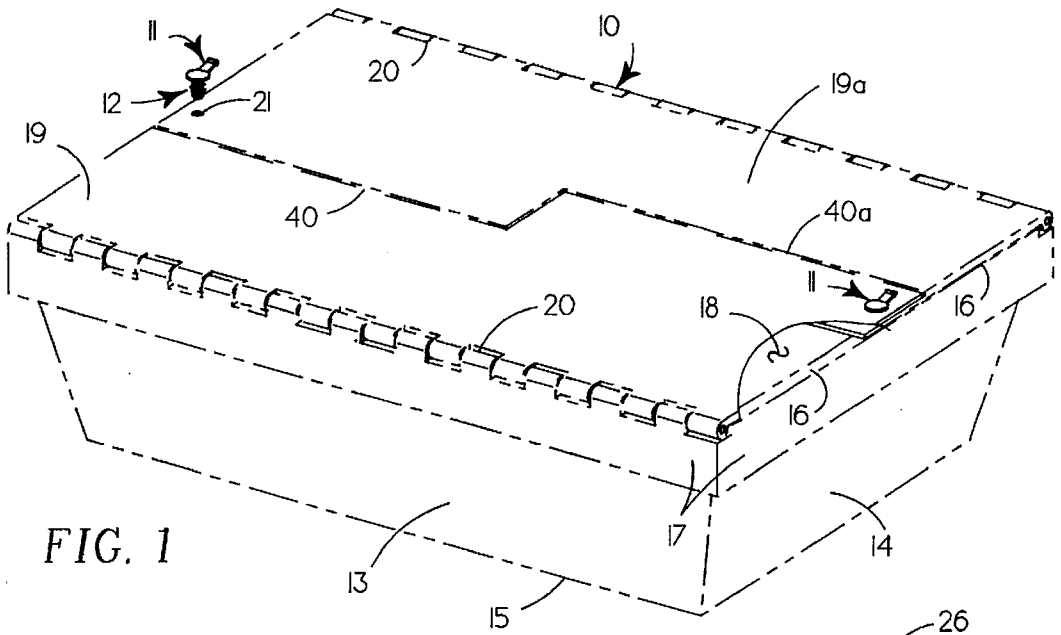
FIG. 1 is an isometric surface view of a typical tote box of present commerce showing the use of our fastener therewith.

Tote boxes 10 used for the containment and carriage of various merchandise, and particularly those used in the pharmaceutical industry, have various configurational forms, but most have the same essential elements. Such tote boxes, as shown in dashed outline in FIG. 1, provide a peripherally defined box formed by similar sides 13, similar ends 14 and bottom 15, all structurally joined at their intersecting edges to form a five-sided, open-top box structure. The elements are so configured that the box structure normally comprises a truncated pyramidal structure with rectangular cross-section and base uppermost, so that a plurality of such boxes may be stacked, one within another, to provide a smaller compact volume for storage than would a similar number of disarrayed boxes. The upper rim 16 of the box normally is somewhat thicker than the box elements therebelow and in the instance illustrated, provides a peripheral skirt 17 depending spacedly adjacent the associated body surface to serve as somewhat of a handle structure to aid manual manipulation of the box. Normally the various edges and corners of the box structure are somewhat rounded to prevent damage to other boxes or structures with which the tote box may come into contact and to aid in preventing injuries to workmen handling the boxes.

The upper orifice 18 of the box defined by rim 16 is planar and normally provided with some closure means. In the instance illustrated in FIG. 1, the top closure member comprises two flat planar top elements 19, 19*a*, each pivotally joined to one of the opposite side edges 13 by piano-type hinge 20 for pivotal motion from the closed horizontal position shown in FIG. 1, at least to a vertical position and normally to a substantially greater angled position that allows the inner edges of the top elements 19, 19*a* when open to depend vertically or rest on a surface supporting the box. The inner edges 40, 40*a* of each top element overlap each other to form a medial area having two layers of the inner portions of each top element overlapping in vertical adjacency. With such a structure fastening holes 21 are defined, normally spacedly inwardly from each end and each inner edge of the top elements, to extend through the medial overlapping portions of both top elements to carry a fastener therein to fasten the top elements in the closed relationship illustrated.

Though the closure of tote boxes is most commonly accomplished by two pivotally mounted top elements that are mounted on opposed side edges to pivot toward and away from each other, as shown in FIG. 1, other configurations of box closures are known and used. An older but still used form of closure (not shown) provides a single planar top element pivoted at one edge and extending over the entire upper orifice 18 of the box structure. Another still older type of tote box cover (not shown) provides a flat planar cover element having a spacedly downwardly depending skirt about its periphery so that it may fit over the outer portion of top rim 16 of a tote box and be there maintained by its depending skirt and action of gravity. Either of the latter two configurations of top closure elements may provide holes about their peripheral area to cooperate with similar holes vertically therebelow defined in top rim 16 of the tote box so that fasteners may be carried in those holes to fasten the closure element to the box. Various other configurational variations of these closure structures are known, but all generally allow the fastening of one or more top closure elements either to the box they close or if the closure elements overlap, to another closure element. All of these configurational variations that allow fastening of closure elements by an elongate type fastener are within the ambit and scope of our invention.

Figure 2:
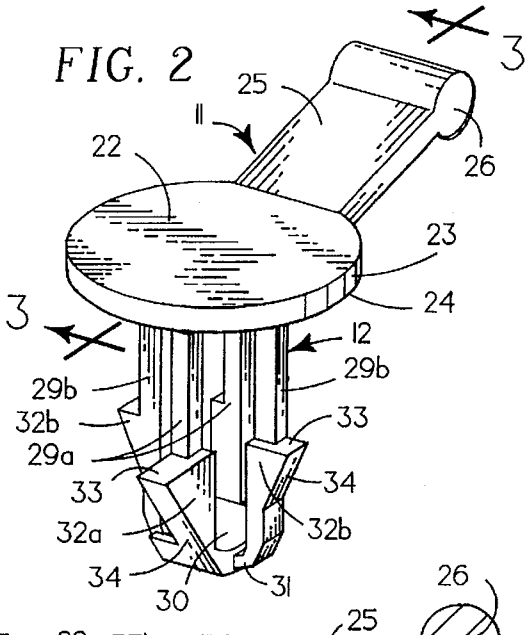
FIG. 2 is a somewhat enlarged, isometric surface view of a first species of fastener having a round head.

Our fastener provides head 11 having flat planar body 22 of some areal extent. In the head body illustrated in FIG. 2, the periphery 23 assumes a substantially circular shape. The lower or inner surface 24 of the head body 22 in this instance is planar to fit in surface adjacency with a planar closure element of a tote box in which the fastener is used. A manipulation tab having elongate body 25 and outer cylindrical enlargement 26, to aid grasping and prevent the fingers of a user from slipping outwardly therefrom, extends from structural joinder with periphery 23 of the top spacedly outwardly therefrom. The manipulation tab may have surfaces configured to aid frictional engagement with the fingers of a user, such as by slots or indentations defined in the surfaces, protuberances extending therefrom or the like (not shown). The configuration of the manipulation tab is not critical to our invention, though the tab itself in its essence is as it provides means to aid the separation of the head from the body of the fastener without use of external tools.

Figure 5:
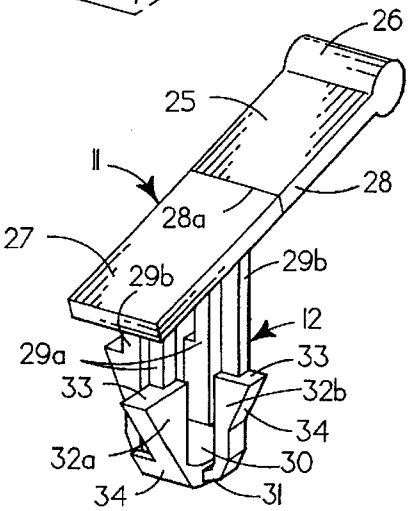
FIG. 5 is an isometric surface view of a second species of fastener having a rectangular head.

The peripheral shape and size of head body 22 is not essential to our invention as long as it has a sufficient areal extent to interconnect the fastener body and is sufficiently larger than a fastening hole 21 in which it is used to prevent the head from passing through the fastening hole. A second species of head body 27 that has an elongate, rectilinear periphery 28 is illustrated in FIG. 5. Here preferably, though not necessarily, tab body 25 is interconnected to a shorter end portion 28*a* of the periphery to provide more leverage for severing the head than would be provided were the tab body interconnected to a longer side edge.

The head body may be of various other configurations with a peripheral shape of a square, a semi-circle or other geometrical form. The particular peripheral shape illustrated in FIG. 5 is often convenient for use with tote boxes that do not have a planar flat surface extending any substantial distance about a fastening hole so that the head of our fastener may fit adjacent any protruding body structure. Some tote boxes have rims projecting upwardly from the surface of their closure elements or other protuberances and often an elongate fastener head will fit inwardly adjacent such structures, whereas a more compact geometric configuration such as a circle or square may not allow such fit. The upper and lower surfaces of the head body also need not necessarily be planar, if some other configuration be required or desired to provide a better or more conformal fit. The configuration of the head surfaces and its periphery are not essential to our invention, and such other shapes are therefore within its spirit, ambit and scope so long as they meet the size requirements specified for the head.

Figure 4:
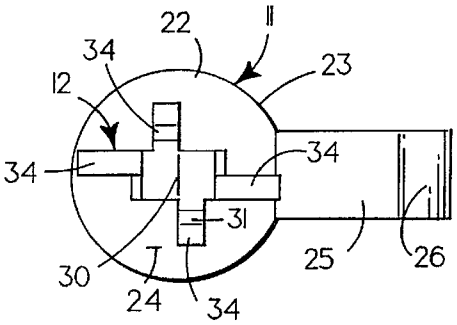
FIG. 4 is an orthographic bottom view of the fastener of FIG. 2.

Fastener body 12 is an elongate structure formed by a plurality of spaced peripheral web elements 29 extending in parallel relationship perpendicularly to head body 22. Each web element is interconnected in its end portion, distal from head body 22, by generally rectilinear bottom 30 which is somewhat peripherally smaller than a hole in which the fastener is to be carried to allow and aid placement. The web elements 29 are all configured and arrayed so that each is spacedly adjacent any other and none are diametrically opposed to any other web, as seen especially in the bottom view of FIG. 4, to allow axially inward deformation of the web elements for establishment of the fastener body in a hole. The radially outer surfaces of the webs define a circumference incrementally smaller than a hole in which the body is to be carried to allow an unstressed containment of the fastener body in that hole.

The set of two generally opposed web elements 29*a* and the set of opposed web elements 29*b* are mirror images of each other, but the two web element sets are not identical to each other. The web elements 29*a* extend directly into structural interconnection with bottom 30, while the web elements 29*b* have a lower inwardly extending curvilinear portion 31 that structurally communicates with the vertical side of bottom 30. Each web element 29 of both sets in its lower portion defines a fastening prong 32 having a perpendicular inner surface 33 extending parallel to head body 22 and an inwardly angled outer surface 34 extending from the areally outer edge of upper surface 33 to bottom 30. Each fastening prong is somewhat thicker and larger in cross-sectional size than the web portion thereabove extending toward the head body 22 to provide greater resilience in the middle portion of the web elements to allow appropriate deformation for insertion of the fastener into a hole.

The fastening prongs on each web element need not be, and in the instance illustrated are not, of identical configuration. The configuration may be varied by known engineering principles to regulate the holding ability or force necessary to place or remove the fastener from a hole. In the instance illustrated, the fastening prongs 32*a* carried by web elements 29*a* extend radially outwardly further than the similar fastening prongs 32*b* carried by web elements 29*b* to provide a fastener that requires a somewhat greater force for insertion or removal than would a fastener wherein all of the prongs were of the type of the prongs 32*b*. The different sized prongs in the instance illustrated, it is to be noted, are arrayed with the larger prongs aligned parallel to tab body 25 to better sustain force parallel to the tab body which is created when the head body 22 is severed.

Figure 3:
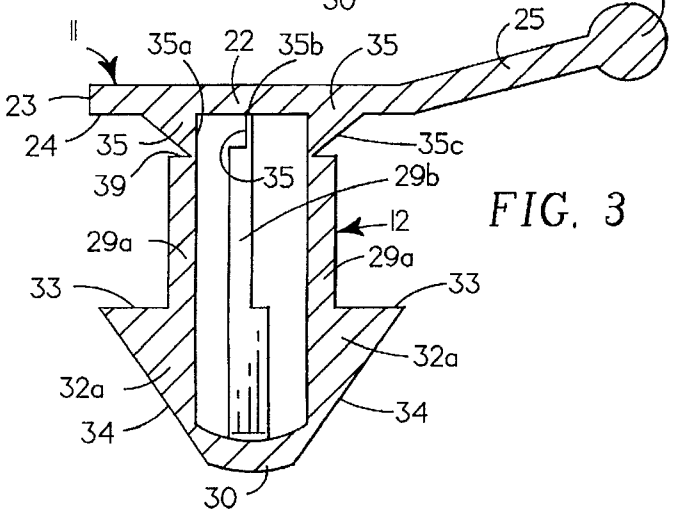
FIG. 3 is a medial, vertical, cross-sectional view through the fastener of FIG. 2, taken on the line 3—3 thereon in the direction indicated by the arrows.

The interconnection of the fastener body with the head is shown particularly in the cross-sectional view of FIG. 3. Fastening links 35 structurally communicate from the lower surface of head body 22 to the upper portion of each of the web elements 29 that form the fastening body. In the instance illustrated, these fastener links are of triangular shape with leg 35*a* parallel to the radially inner surface of the web it interconnects and leg 35*b* parallel to the adjacent surface of the head body 22. The angled side 35*c* of the fastener link communicates with the web spacedly distant from the side 35*a* to form a slightly truncated triangular configuration, with the truncated surface communicating with the web at its smallest cross-sectional area. The fastener links, in the instance illustrated, are also thinner than the associated web to provide a connecting area that is of appropriate cross-sectional size to require a predetermined force to sever the fastener link from the adjoined webs. The particular configuration and relative sizing of the fastener links as illustrated are not critical to our invention. The only critical element is the area of the cross-sectional portion that interconnects the connector with the webs which determines the force necessary to sever the head from the webs. Other shapes and configurations of fastener links are therefore within the ambit and scope of our invention so long as they require the appropriate predetermined force for severance.

Having thusly described the structure of our fastener, its use may be understood.

A plurality of fasteners are formed according to the foregoing specification for use with a tote box such as shown in FIG. 1 or one of the other tote boxes having closure elements fastenable by an elongate fastener depending through paired cooperating holes defined in two overlapping closure elements or in one closure element and the box. A circumference through the radial outer surface of the webs 29 of the fastener body is defined to be incrementally less than the diameter of a hole that is to carry the fastener. The fastening prongs are sized so that the distance between the radially outermost portions of at least one generally opposed pair, and preferably both generally opposed pairs of fastening prongs, is greater than the diameter of the hole in which the fastener is to be inserted. The distance between the adjacent surfaces of the fastener head and the prongs is determined to be incrementally greater than the axial length of the holes that are to carry the fastener.

For insertion, a fastener is placed in the outermost portion of a cooperating pair of fastening holes 21 with the smaller bottom portion in the orifice of the hole in which the fastener is to be inserted. The fastener in this condition is manually pressed inwardly toward the hole by exerting somewhat axially aligned pressure on its head 11. With the commencement of pressure application, the fastener will start to be somewhat deformed in the hole orifice by contact of the orifice with angulated sides 34 of the fastening prongs. As manual pressure is increased, the force exerted on the angulated sides of the fastening prongs will have an axially inwardly directed component and as the pressure increases and the prongs move into the hole, the inward component will become sufficient to cause inwardly directed deformation of the fastening prongs. The axially inwardly directed force is continued until the horizontal component becomes sufficient to deform the webs to allow the prongs to move radially inwardly a distance sufficient so that they pass through and exit from the the hole, distal from the insertion orifice. After the fastening prongs have passed completely through the fastening hole, they are not peripherally restrained, and, by reason of their resilient deformability and their retentent memory, the prongs and associated webs will return to their normal non-deformed configuration, with the upper surface 33 of the fastening prongs on one side of the fastening hole and the head on the other side to maintain the fastener in the hole carrying it.

After the fastener is once installed in a closed tote box, it cannot be removed without physical destruction of some sort as the end structure of the fastener distal from its head is inaccessible and larger than the hole carrying the webs.

It is to be noted that the structural configuration of our fastener is adapted to aid its insertion in fastening holes. The deformation of the fastening prongs is aided by a relatively small cross-sectional area of material between the prong and its associated web communicating with the bottom structure to allow more ready flexure of the material at this point. The web structure between the prongs and fastener head is also of smaller cross-sectional area than the combined web and prong structure distal therefrom, again to allow flexure of the web elements to aid the radially inward motion of the prongs during the insertion process.

The physical characteristics of the material from which the fastener is formed and the relative dimensions and configuration of its elements, however, must be coordinated to provide a fastener that can be inserted in tote box fastening holes with reasonable manual pressure normally exerted by the thumb or fingers of a user. The material also must have sufficient elasticity or retentent memory to return substantially to its prior configuration within a short time after deformation. The determination of appropriate materials, configurations and dimensions are all within the ability of a reasonably skilled worker in the plastic arts. The relationships between fastener elements shown in the drawings are preferred for a fastener formed of ordinary commercially available polyvinyl or polycarbonate plastics. It is to be noted that the distance between upper surfaces 33 of the prongs and the adjacent surface of head 11 must be slightly greater than the thickness of the material defining holes through which the fastener is to be inserted to accommodate the sloping edge 35*c* of fastening links 35, but preferably this distance should not be appreciably greater than required.

To remove the fastener, when it be desired to open a tote box, the head 11 is severed from body 12 by manual manipulation. To accomplish this, tab body 25 is grasped, generally between a user's finger and thumb. The tab body 25 is moved upwardly away from the fastener hole and toward head 11. During this procedure, a user's fingers are aided in their grip on the tab body 25 by the cylindrical enlargement 26 at in the end portion. When sufficient force is applied to the tab body, the fastener link 35 nearest the tab body will be severed from the interconnected web of the fastener body at the interconnection between the fastener link and the associated web. Similar force is continued by moving the tab body toward unsevered interconnections between the head and body until all interconnections have been severed and the head completely removed from the body. At this point the closure elements of the box are no longer fastened and may be opened.

It is to be noted that to aid this severance, the cross-sectional area of material interconnecting a fastener link 35 with an associated web is less than the area of any cross-sections of either element on either side of the interconnection, so that the interconnection will be the weakest point between the head and body. The severance is also aided by the angulated notch 39 formed between the interconnected elements. The acute inner portion of this notch concentrates strain and aids severance at that point.

It is to be noted that the amount of force required to sever the interconnection between fastener links 35 and of webs 29 is determined largely by the smallest cross-sectional area of material therebetween and the nature and tensile strength of that material. The force required to sever the head from the body may therefore be selectively determined by determining the nature of the material from which the fastener is formed and varying the size of the smallest cross-sectional area between the head and body. The knowledge and ability to make such determinations are within the faculty of an ordinarily skilled person in the plastic arts.

The foregoing description of our invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described our invention, what we desire to protect by Letters Patent, and

What we claim is:

1. A tamperproof, breakaway fastener for insertion in cooperating holes defined in relatively movable adjacent members of a box to maintain interconnection after placement and require manual destruction for removal, comprising in combination:

a head defining a head body larger than the holes to carry the fastener, said head body having a tab extending from the periphery thereof and plural fastener links depending in spaced array therefrom; and an elongate body incrementally smaller than holes in which it is carried and peripherally defined by a plurality of spaced webs having first and second ends, each web interconnected at the first end to one of the connector links carried by the head and extendingaway therefrom, interconnected at the first end to a common bottom and defining an outwardly extending fastening prong deformable inwardly for insertion through holes and thereafter expandable outwardly by retentent memory to prevent removal of the fastener from the holes, and the interconnection of each fastening link carried by the head with the associated web being areally smaller than the web and fastening link on either side of the interconnection to allow severance of the head from the body by manual manipulation of the tab without the use of tools.

2. An elongate fastener, that cannot be removed without destruction, for insertion in adjacent cooperating fastening holes defined in adjacent relatively movable members of a box structure, comprising in combination:

a head having a body areally larger than holes to carry the fastener, said head having a tab extending spacedly from the periphery thereof to aid manipulation, and a plurality of fastening links, carried in spaced array on the body to extend spacedly therefrom, with an outermost portion distal from the head having the smallest cross-sectional area; and an elongate body, formed by spaced resiliently deformable webs, defining a periphery incrementally smaller than holes to carry the fastener and having first and second ends, each web interconnected at the first end to the outermost portion of one fastening link carried by the head, defining a cross-sectional area larger than the smallest cross-sectional area of the interconnected fastening link, interconnected at the second end distal from the head to a common bottom, and having a fastening prong extending a spaced distance radially outwardly from the web.

3. The fastener of claim 2 further characterized by:

the fastener body being formed by two perpendicular sets of two pairs of similar spaced webs, the first set of said webs extending substantially parallel to the tab carried by the head.

4. The fastener of claim 3 further characterized by:

the fastening prongs carried by the first set of webs extending outwardly a greater distance than the fastening prongs defined by the second set of webs.

5. The fastener of claim 2 further characterized by:

the web portion between each fastening prong and fastening link having a smaller cross-sectional area than the web portion defining the fastening prong, and the smallest cross-sectional area of each web distal from the fastening prong being substantially at the interconnection of the web with the bottom, all to aid inward deformation of the fastening prongs for insertion in fastening holes smaller than a circumference about the outer portion of the fastening prongs.

* * * * *